United States Patent [19]

Achelpohl

[11] 4,178,031

[45] Dec. 11, 1979

[54] LIFTING GEAR FOR FILLED SACKS

[75] Inventor: Fritz Achelpohl, Lengerich, Fed. Rep. of Germany

[73] Assignee: Windmoller & Holscher, Lengerich, Fed. Rep. of Germany

[21] Appl. No.: 874,155

[22] Filed: Feb. 1, 1978

[30] Foreign Application Priority Data

Feb. 4, 1977 [DE] Fed. Rep. of Germany ..... 2704732

[51] Int. Cl.[2] ..... B66C 1/58

[52] U.S. Cl. ..... 294/82 R; 229/54 R

[58] Field of Search ..... 294/82 R, 81 R, 83 R, 294/78 R, 74; 229/54 R; 16/125; 24/305 R; 150/12; 223/91, 96; 224/45 H, 45 W

[56] References Cited

U.S. PATENT DOCUMENTS 3,937,394 2/1976 Netschert ..... 229/54 R

FOREIGN PATENT DOCUMENTS 2317216 7/1975 France ..... 294/74

*Primary Examiner*—James B. Marbert

*Attorney, Agent, or Firm*—Fleit & Jacobson

[57] ABSTRACT

A supporting frame for suspending a filled sack from the hook of a crane comprises a rod of substantially triangular shape. The end of the sack adjacent the mouth is gathered, flattened and folded onto itself to define two sack layers. Both layers are laid over a first limb of the triangle that is opposite the apex and a clamping bar having a flanged end is inserted between the sack layers adjacent the fold line with the flanged end resting against a second limb of the triangle.

3 Claims, 2 Drawing Figures

Figure 1:
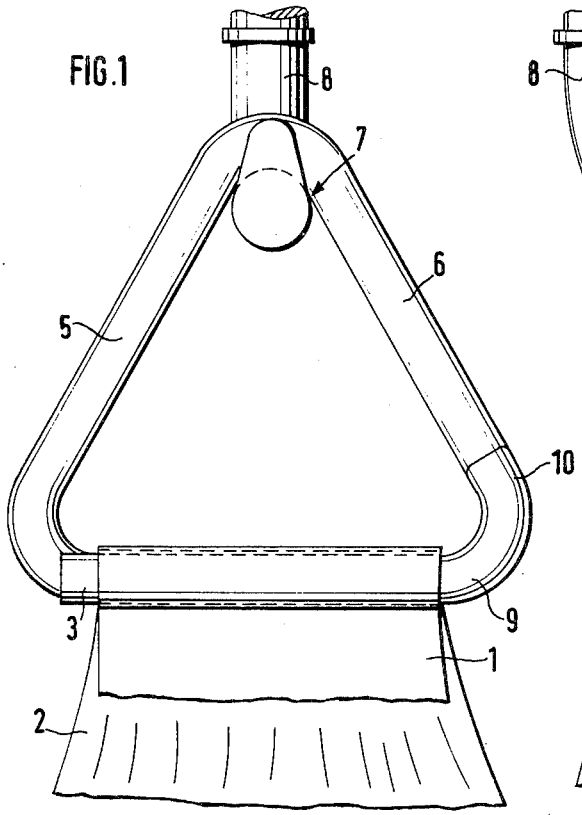

8
7
6
5
10
9
3
1
2

8
5,6
10
4
9
3
1
2

LIFTING GEAR FOR FILLED SACKS

The invention relates to an annular supporting frame for lifting a filled sack, comprising a pair of clamping bars about which the gathered and flattened end of the sack is slung.

A supporting frame of this kind known from U.S. Pat. No. 3,937,394 but which serves only as a releasable carrying handle for paper bags or like flexible articles is bent from spring wire. At the side opposite the handle, it comprises a pair of substantially parallel clamping bars of which the ends are bent so that each bar resiliently embraces the other bar. To grip the end of the bag to be carried, the handle side of the supporting frame is held downwardly and the end of the bag is placed between the two clamping bars by being slung about the now lower clamping bar of the supporting frame. If, now, the handle of the supporting frame is swung upwardly to its carrying position, the end of the bag will envelop the clamping bars and pull the latter together in a tight clamping connection by becoming taut. However, even if the known supporting frame is appropriately modified, it is not suitable as a coupling for suspending the heavy filled sack from the hooks of cranes. This is because the appropriately robustly constructed frame suspended from the hook of the crane would have to be lifted to enable the end of the sack to be introduced between the clamping bars. However, in the case of large sacks and the weight of the supporting frame necessary to lift same, the operator is unable to cope because he would have to exert an excessively high bodily strain. Further, it would have to be possible to move the clamping bars resiliently towards one another which, again, would be impossible if the known supporting frame is of heavy duty construction.

It is therefore the problem of the invention to provide a supporting frame for lifting heavy filled sacks and that can be suspended from the hook of a crane and be easily manipulated.

According to the invention, this problem is solved in that the supporting frame comprises a triangular lug about the clamping bar of which that is opposite the supporting angle for suspending from the hook of a crane there is placed that end of the sack which is folded onto itself to form a loop through which a second clamping bar is pushed which has a flanged end piece by which it is supported on a limb of the lug connecting the clamping bar to the supporting angle. To engage the sack, the end of the sack is folded back onto itself over such a length that it can be placed over the clamping bar of the supporting frame according to the invention whilst forming a loop. The loose second clamping bar is pushed through the loop and its flanged end is brought into registry with one of the two arms of the triangular lug. The flanged end of the second clamping bar prevents rotation of the clamping bar about itself, which would otherwise cause the end of the sack to rotate continuously and unwind from the second clamping bar, whereby the sack would become released from the clamp connection.

To release the supporting frame, it suffices to deposit the sack, whereby the second clamping bar becomes loose and can be pulled laterally out of the loop.

Figure 2:
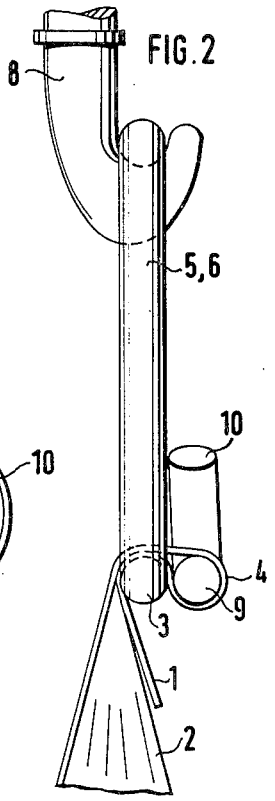

An example of the invention will now be described in more detail with reference to the drawing, wherein:

FIG. 1 is a side elevation of the supporting frame with the upper end of the sack clamped therein, and FIG. 2 is an end elevation of the FIG. 1 supporting frame.

One end 1 of a sack 2 is folded onto itself, placed over a first clamping bar 3 and forms a loop 4 on the side of the sack remote from the side of the clamping bar 3. The clamping bar 3 comprises two arms 5, 6 which are interconnected by welding, soldering or in any other known manner to form a substantially equilateral triangle of which the angle 7 opposite the clamping bar 3 can be engaged by the hook 8 of a crane. A second clamping bar 9 having a flanged end 10 is pushed through the loop 4. The second clamping bar 9 is preferably introduced in the loop 4 to an extent such that the flanged end 10 comes into registry with one of the arms 5 or 6. During lifting of the sack, the flange 10 lies against the arm 5 or 6 so that the second clamping bar 9 cannot turn about its own axis and the end of the sack cannot unwind itself therefrom. The present apparatus provides simple but secure means for lifting heavy sacks. After depositing the sack, the second clamping bar 9 can be readily pulled out of the loop 4 again so that the sack becomes released from the apparatus by way of a single manipulation.

What is claimed is:

1. An annular supporting frame for lifting a filled sack, comprising a pair of clamping bars about which the gathered and flattened end of the sack is slung, characterised in that the supporting frame comprises a triangular lug (3, 5, 6) about the clamping bar (3) of which that is opposite the supporting angle (7) for suspending from the hook (8) of a crane there is placed that end (1) of the sack which is folded onto itself to form a loop (4) through which a second clamping bar (9) is pushed which has a flanged end piece (10) by which it is supported on a limb (6) of the lug connecting the clamping bar (3) to the supporting angle (7).

2. An annular supporting frame for suspending a sack from a lifting device, comprising:

a generally-triangular shaped lug having a horizontally-extending base forming a first clamping bar, and limbs extending upwards from ends of the base and meeting at an apex, the apex being adapted to receive means for suspending the frame from a lifting device;

a second clamping bar horizontally movable with respect to said first clamping bar and having a flanged end piece engageable with one of the limbs of said lug to limit rotational movement of said second clamping bar by the weight of a suspended sack, the suspended sack having an end thereof gathered, flattened, and folded onto itself to form a loop, the loop being passed through the lug, the second clamping bar being pushed through the loop so that the weight of the suspended sack urges said second clamping bar towards said first clamping bar thereby clamping the end of the sack between said clamping bars.

3. A method of connecting a sack to be lifted to an annular supporting frame, the frame having a horizontally-extending base forming a first clamping bar, an apex positioned above the base, and engageable by a device for lifting the sack, and limbs connecting the apex to the base; and a second clamping bar movable with respect to said first clamping bar and having a flanged end piece engageable with one of said limbs to limit rotational movement of said second clamping bar, the method comprising:

gathering, flattening, and folding an end of a sack to be lifted onto itself to form a loop;

passing the folded end through the frame;

pushing the second clamping bar through the loop until the clamping bars are adjacent to each other, with the flanged end piece being adjacent to one of the limbs of the supporting frame; and lifting the supporting frame so that the weight of the sack urges the clamping bars towards each other and urges the flanged end piece into contact with the limb, thereby connecting the sack to the frame.

* * * * *